US009422143B1

(12) United States Patent
Truscott

(10) Patent No.: US 9,422,143 B1
(45) Date of Patent: Aug. 23, 2016

(54) HANDHELD EXTENDABLE POLE WITH A ROTATABLE TIP DESIGNED TO FIT SMOKE DETECTOR BUTTONS

(71) Applicant: James Truscott, Garland, TX (US)

(72) Inventor: James Truscott, Garland, TX (US)

( * ) Notice: Subject to any disclaimer, the term of this patent is extended or adjusted under 35 U.S.C. 154(b) by 0 days.

(21) Appl. No.: 14/565,901

(22) Filed: Dec. 10, 2014

Related U.S. Application Data

(60) Provisional application No. 61/914,683, filed on Dec. 11, 2013.

(51) Int. Cl.
*B66F 19/00* (2006.01)

(52) U.S. Cl.
CPC ..... *B66F 19/00* (2013.01)

(58) Field of Classification Search
CPC ..... B66F 19/00
USPC ..... 254/1
See application file for complete search history.

(56) References Cited

U.S. PATENT DOCUMENTS 4,318,228 A * 3/1982 Kimura ..... G01C 15/08 33/296
D276,690 S * 12/1984 Hamatani ..... D8/107
5,381,319 A * 1/1995 Shiao ..... B25B 9/00 135/910
5,487,576 A * 1/1996 DuVivier ..... B25B 9/00 294/210
5,615,920 A * 4/1997 O'Kane ..... B25B 11/002 294/65.5
5,873,175 A * 2/1999 Johnston ..... G01B 3/08 33/783
6,065,787 A * 5/2000 Jarosch ..... B25B 9/00 294/210
6,698,906 B1 * 3/2004 Tally ..... B25B 9/00 359/864
2004/0100109 A1 * 5/2004 Johnson ..... B25J 1/04 294/26
2005/0200143 A1 * 9/2005 Maestas ..... F21L 4/04 294/65.5

* cited by examiner

*Primary Examiner* — Joseph J Hail
*Assistant Examiner* — Henry Hong
(74) *Attorney, Agent, or Firm* — Plager Schack LLP

(57) ABSTRACT

Some embodiments of the present disclosure include a collapsible system for depressing a button on a device, such as a smoke detector, that is out of reach. The system may include a generally cylindrically-shaped handle having an inner portion and a proximal end and a distal end, a plurality of extendable segments configured to telescope outwardly from the inner portion of the handle through the distal end of the handle, the plurality of extendable segments including a distal-most segment, and a tip rotatably attached to the distal-most segment of the plurality of extendable segments. The tip may have a concave portion configured to accommodate at least a portion of the device button when in contact with the device button.

10 Claims, 5 Drawing Sheets

HANDHELD EXTENDABLE POLE WITH A ROTATABLE TIP DESIGNED TO FIT SMOKE DETECTOR BUTTONS

RELATED APPLICATION

This application claims priority to provisional patent application U.S. Ser. No. 61/914,683 filed on Dec. 11, 2013, the entire contents of which is herein incorporated by reference.

BACKGROUND

The embodiments herein relate generally to tools, and more particularly, to a handheld device for testing smoke detectors.

Smoke detectors are used in buildings and function to alert people therein to the presence of smoke in the building. Smoke detectors should be routinely tested to verify that they are properly functioning. However, smoke detectors are often placed in high or hard to reach places. Thus, a device is needed that is capable of testing smoke detectors, even when the smoke detectors are located in hard to reach places.

Canned smoke is one type of device used to test smoke detectors. However, canned smoke is depleted upon use, meaning that new cans must constantly be purchased to test smoke detectors. Using canned smoke also includes using a long pole to make the can close enough to the smoke detector to effectively test the smoke detector. These long poles are burdensome and not easily carried.

Therefore, what is needed is a tool, which is easily carried and not depleted upon use thereof, for effectively testing smoke detectors.

SUMMARY

Some embodiments of the present disclosure include a collapsible system for depressing a button on a device, such as a smoke detector, that is out of reach. The system may include a generally cylindrically-shaped handle having an inner portion and a proximal end and a distal end, a plurality of extendable segments configured to telescope outwardly from the inner portion of the handle through the distal end of the handle, the plurality of extendable segments including a distal-most segment, and a tip rotatably attached to the distal-most segment of the plurality of extendable segments. The tip may have a concave portion configured to accommodate at least a portion of the device button when in contact with the device button.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to test smoke detectors and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Handle
2. Extendable Segments
3. Rotatably Attached Tip

The various elements of the collapsible system for depressing a button on a device that is out of reach of the present disclosure may be related in the following exemplary fashion. It is not intended to limit the scope or nature of the relationships between the various elements and the following examples are presented as illustrative examples only.

By way of example, and referring to FIGS. 1-13, some embodiments of collapsible system for depressing a button on a device of the present disclosure comprise an extendable pole 10 having a rotatable tip 98 that is designed to fit buttons, such as smoke detector buttons 102. In its unextended state, embodiments of the collapsible system may collapse to a total length of about 5 to about 10 inches, such as about 6¾ inches with the tip 98 positioned at a 90° angle and about 7¾ inches with the tip 98 straight out or at a 0° angle. In its fully extended state, embodiments of the system may be about 5 feet long.

Figure 1:
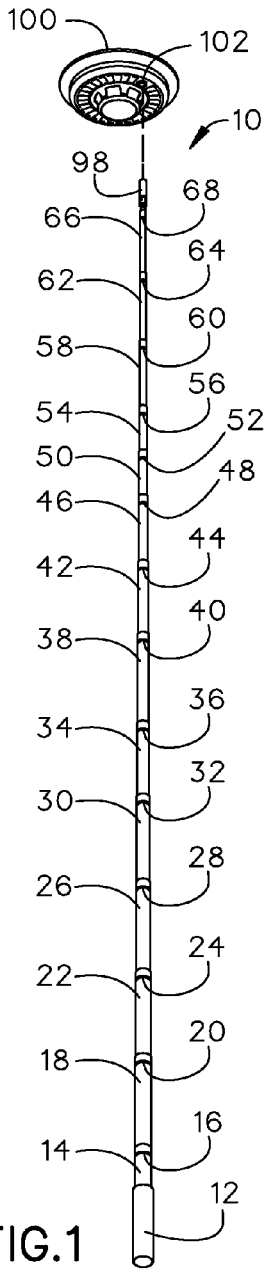
FIG. 1 is a bottom perspective view of one embodiment of the present invention shown in use.
Figure 2:
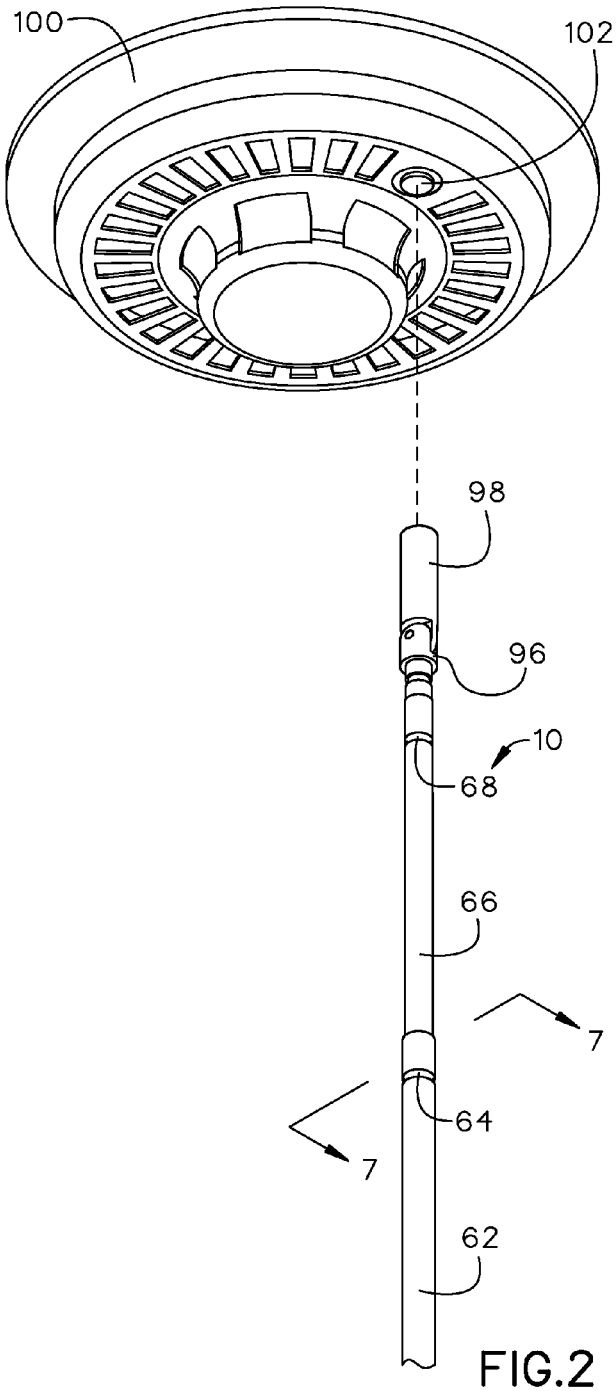
FIG. 2 is a detail bottom perspective view of one embodiment of the present invention shown in use.
Figure 3:
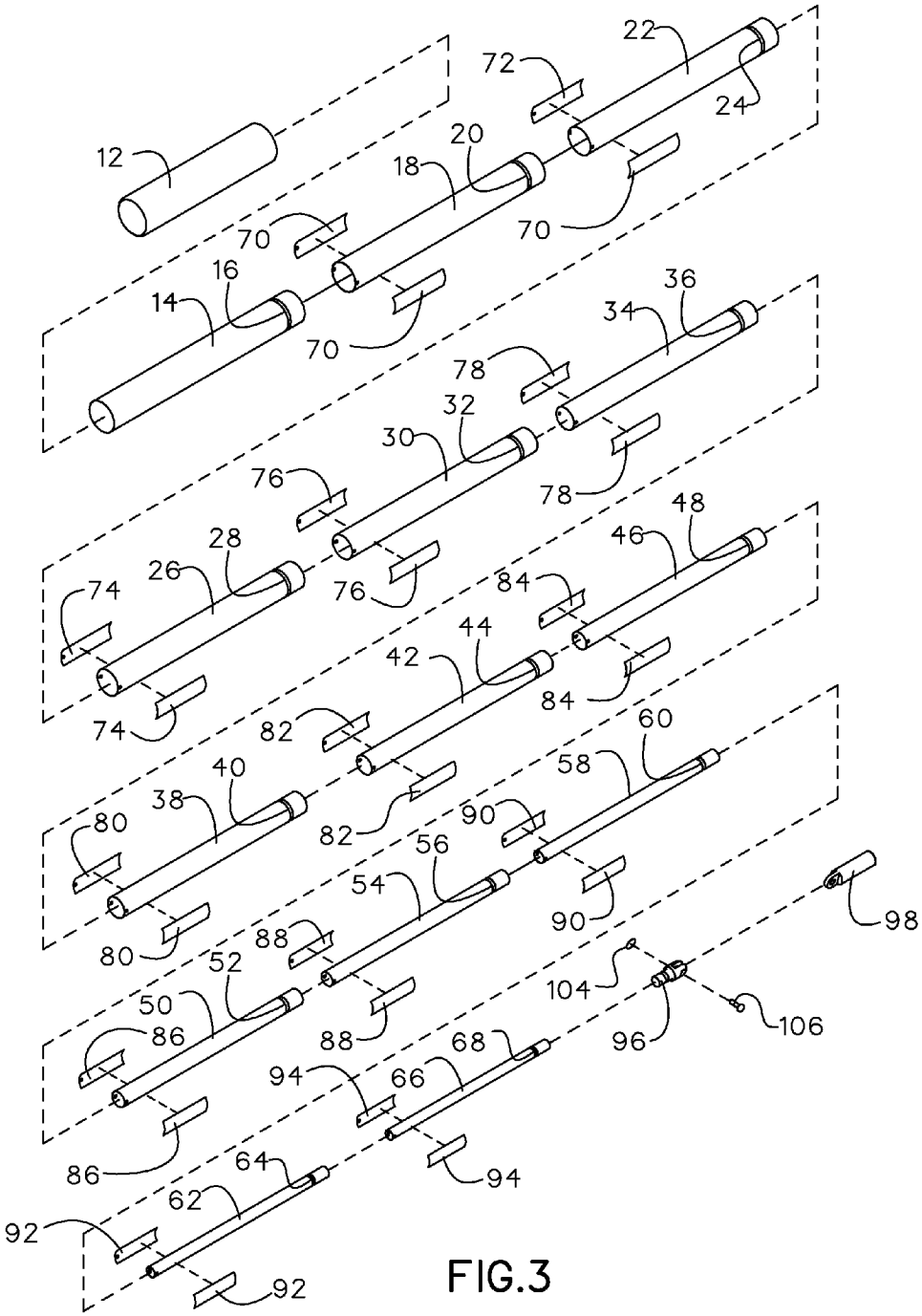
FIG. 3 is an exploded view of one embodiment of the present invention.
Figure 4:
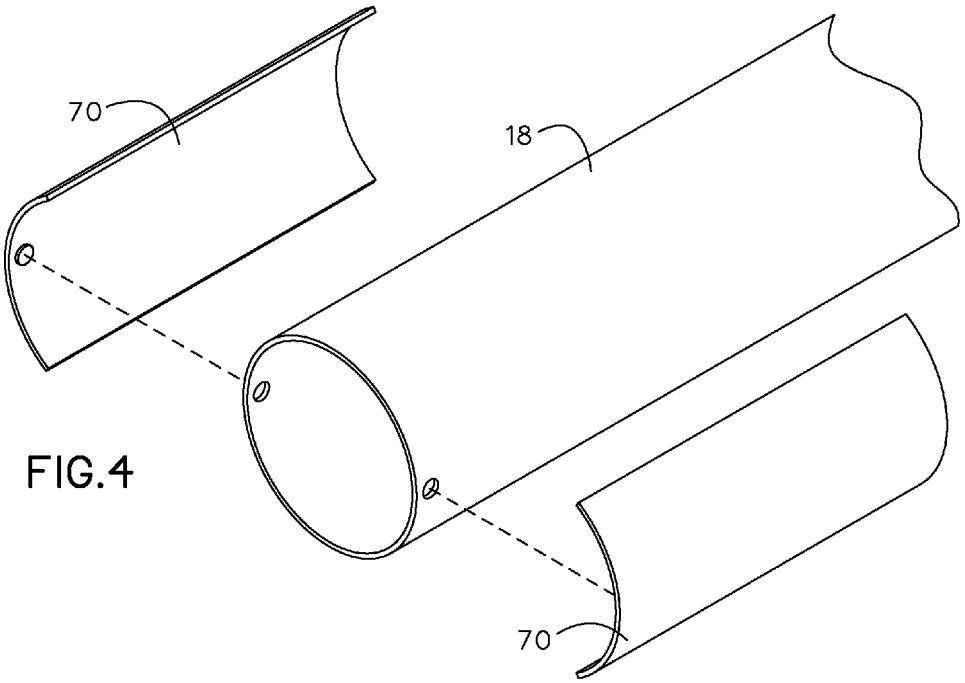
FIG. 4 is a detail exploded view of one embodiment of the present invention.
Figure 5:
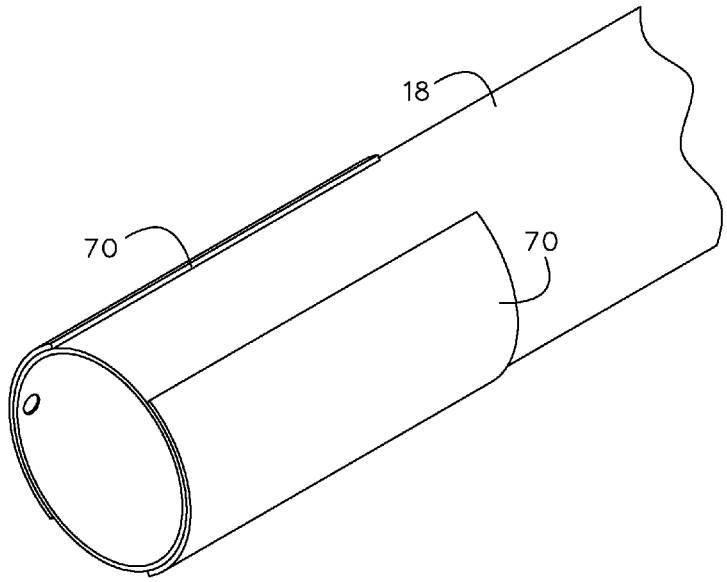
FIG. 5 is a detail perspective view of one embodiment of the present invention.
Figure 6:
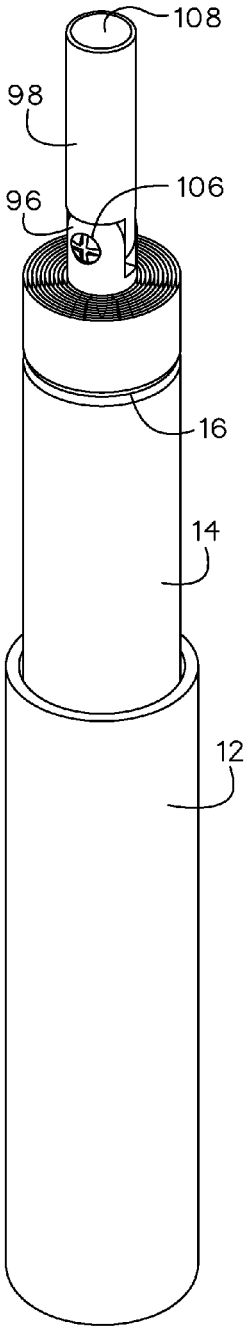
FIG. 6 is a perspective view of one embodiment of the present invention shown in collapsed state.
Figure 7:
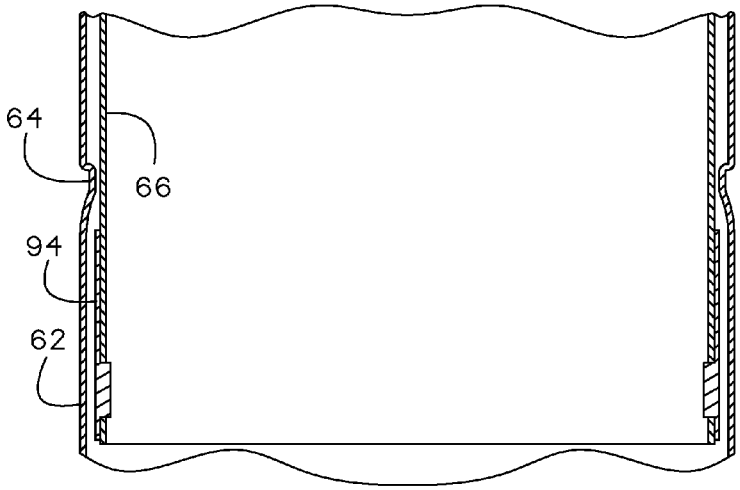
FIG. 7 is a detail section view of one embodiment of the present invention along line 7-7 in FIG. 2 shown in an unlocked state.
Figure 8:
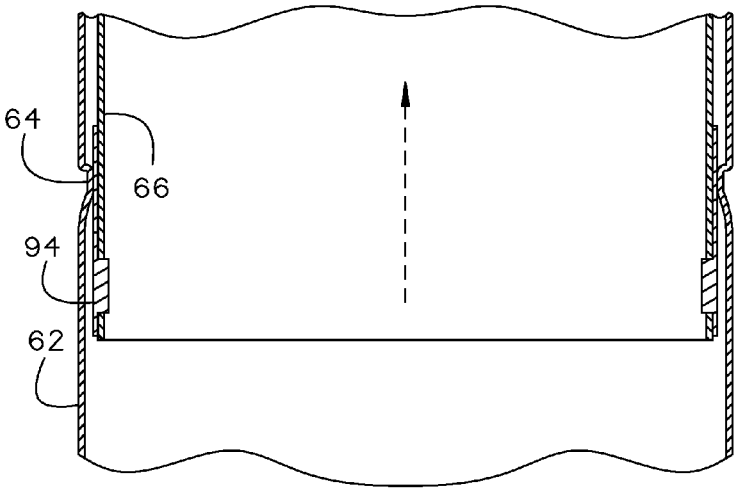
FIG. 8 is a detail section view of one embodiment of the present invention shown in a locked state.

In some embodiments, the extendable pole 10 includes a handle 12, several extendable segments, such as about 10 to about 20 segments, such as 14 segments (shown as items 14, 18, 22, 26, 30, 34, 38, 42, 46, 50, 54, 58, 62, and 66 in the figures), and a rotatable tip 98, wherein the segments are configured to collapse into each other and into the handle in a telescoping fashion. The segments may each comprise a notch (16, 20, 24, 28, 32, 36, 40, 44, 48, 52, 56, 60, 64, and 68) positioned at a distal end of each segment, the notches configured to help lock the segments in an extended state, as shown in FIG. 1, and also in a non-extended or collapsed state, as shown in FIG. 6. Each of the segments may also have a sheet bearing (70, 72, 74, 76, 78, 80, 82, 84, 86, 88, 90, 92, and 94), wherein the sheet bearing aids in keeping the extendable pole 10 in its desired position—either extended or collapsed. As shown in FIGS. 4 and 5, each segment may have a sheet bearing attached to an end of the segment opposite the notch, wherein the segment may comprise a tap configured to snap into an orifice on the segment. As shown in FIG. 8, the sheet bearing 94 on a second segment 66 may engage with the notch 64 on a first segment 62 to lock the segments in an extended state. In some embodiments, the sheet bearings may comprise copper.

Figure 9:
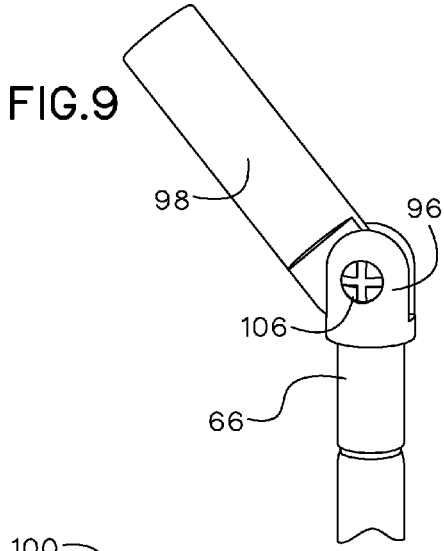
FIG. 9 is a detail perspective view of one embodiment of the present invention shown in an exemplary primary state.
Figure 10:
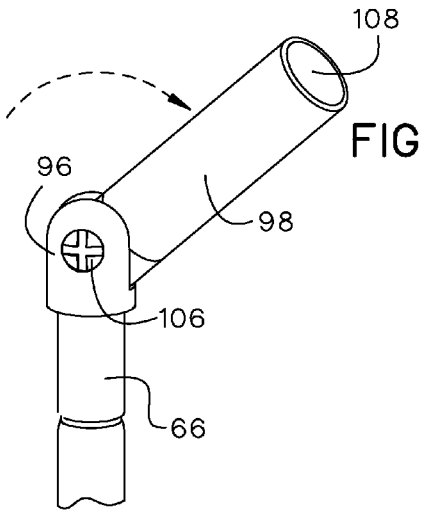
FIG. 10 is a detail perspective view of one embodiment of the present invention shown in an exemplary second state.

The rotatable tip 98 may be attached to a distal-most segment 66 from the handle 12, such that the rotatable tip 98 may be rotated at any angle co-liner with the handle 12 to at least perpendicular to the handle 12. For example, the rotatable tip 98 may be attached to a base 96 that is attached to the distal-most segment 66. In some embodiments, the rotatable tip 98 is attached to the base 96 using a fastener 106 and a washer 104, as shown in FIGS. 9 and 10. The rotatable tip 98 may be substantially cylindrical in shape with (i) an attaching portion at a proximal end of the rotatable tip 98, which attaches to the base 96, and (ii) a notched portion 108 at a distal-most end of the rotatable tip 98. In some embodiments, the notched portion 108 may comprise a concave surface configured to accommodate a portion of a button of a device when in contact with the button. For example, the notched portion 108 may accommodate a button 102 on a smoke detector 100, wherein the button 108 is used for testing the functionality of the smoke detector 100. Specifically, in some embodiments, the notched portion 108 is designed to accommodate a smoke-detector button having a size of ⅜ inch. In embodiments, the rotatable tip 98 may be magnetic and may comprise a light to help a user see the button that he or she is wishing to press.

In embodiments, the handle 12 may be generally cylindrically-shaped having an inner portion, a proximal end, and a distal end. In some embodiments, the handle 12 may comprise a covering made of a material such as vinyl, rubber, plastic, or the like, wherein the covering functions as a grip and padding. The handle 12 may have any desired size and, in some embodiments, has a length of about 5 to about 6 inches. The diameter of the handle 12 may be a size such that the extendable sections may collapse into the handle 12, as shown in FIG. 6.

As shown in the figures, the extendable segments may be generally cylindrically-shaped and may have an inner portion, a proximal end, and a distal end. The plurality of extendable segments may be configured to telescope from the inner portion of the handle 12 through the distal end of the handle 12. In embodiments, the diameter of the segments beginning from the proximal extendable segment 14, i.e., the segment closest to the handle 12, to the distal extendable segment 66, i.e., the segment nearest the rotatable tip 98, successively decreases such that each segment can collapse into the previous segment. In embodiments, each segment may have a length of, for example, from about 2 inches to about 5 inches. In a particular embodiment, the proximal extendable segment 14 may have a length of about 4 3/16 inches and is the longest segment, and the distal extendable segment 66 may have a length of about 2½ inches and may be the shortest segment.

The extendable pole 10 may be made of any suitable material. For example, the collapsible system may be made of stainless steel allowing the tip to withstand up to 3000 g of force without the device collapsing into its unextended state.

Figure 11:
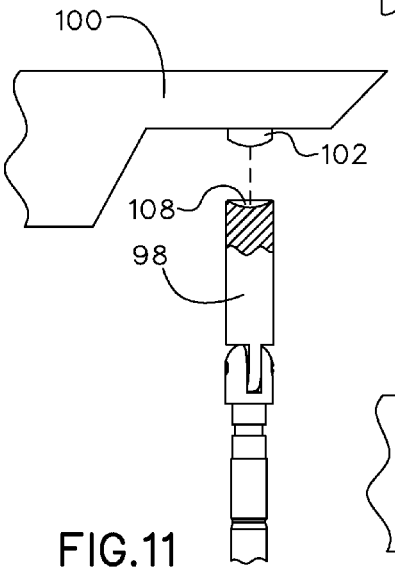
FIG. 11 is a side detail cutaway view of one embodiment of the present invention shown in pre-engagement.
Figure 12:
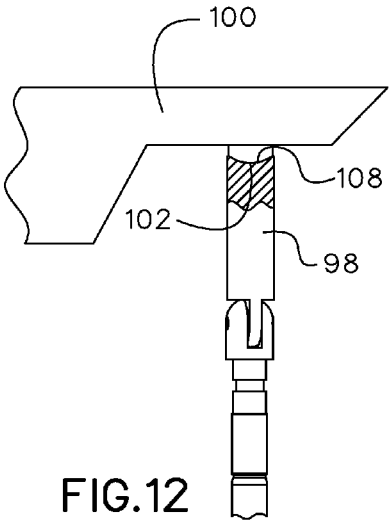
FIG. 12 is a side detail cutaway view of one embodiment of the present invention shown in engaged state.
Figure 13:
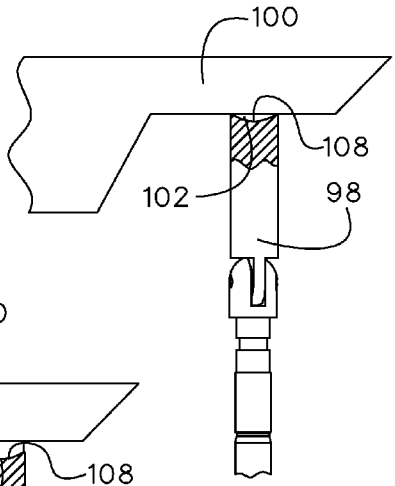
FIG. 13 is a side detail cutaway view of one embodiment of the present invention shown in engaged and force-applied state.

To use the device of the present disclosure, a user may extend the sections to the necessary length to reach a button on a device, such as on a smoke detector 100. As shown in FIGS. 11-13, the tip 98 may be aligned with the button 102 such that the notched portion 108 on the tip 98 aligns with and covers the button 102, wherein the user may then exert force on the device, causing the button 102 to be pressed, testing the functionality of the smoke detector 100.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A collapsible system for depressing a button on a device that is out of reach, the system comprising:

a cylindrically-shaped handle having an inner portion and a proximal end and a distal end;

a plurality of extendable segments configured to telescope outwardly from the inner portion of the handle through the distal end of the handle, the plurality of extendable segments including a distal-most segment; and a tip rotatably attached to the distal-most segment of the plurality of extendable segments, wherein:

the tip comprises a concave portion configured to accommodate at least a portion of the device button when in contact with the device button;

each extendable segment comprises a notch at a distal end of the segment and a sheet bearing attached to a proximal end of the segment, the notch of a first segment configured to put pressure on the sheet bearing of a second segment, resulting in the segments being in a locked configuration, and each sheet bearing comprises a curved sheet of material attached to an external surface of the respective segment.

2. The collapsible system of claim 1, wherein the tip is rotatably attached to the distal-most segment such that rotation of the tip from co-linear with the handle to at least perpendicular to the handle is permitted.

3. The collapsible system of claim 1, wherein the collapsible system is capable of withstanding about 3000 g of force on the tip without collapsing into an unextended state.

4. The collapsible system of claim 1, wherein the system comprises about 14 extendable segments.

5. The collapsible system of claim 1, wherein the system has a total length of about 5 feet when the system is in its fully extended state.

6. The collapsible system of claim 1, wherein the system has a total length of from about 5 to about 10 inches when the system is in its unextended state.

7. The collapsible system of claim 1, wherein the concave portion is dimensioned to accommodate a smoke detector button.

8. The collapsible system of claim 1, wherein each segment comprises a pair of sheet bearings attached thereto.

9. The collapsible system of claim 1, wherein each notch extends inwards toward an internal area of the respective segment.

10. The collapsible system of claim 1, wherein the proximal end of the second segment fits within the distal end of the first segment.

* * * * *